US009617824B2

(12) United States Patent
Sechere et al.

(10) Patent No.: US 9,617,824 B2
(45) Date of Patent: Apr. 11, 2017

(54) RETRIEVAL OF COMPRESSED PACKERS FROM A WELLBORE

(71) Applicant: HALLIBURTON ENERGY SERVICES, INC., Houston, TX (US)

(72) Inventors: Karla Sechere, Carrollton, TX (US); William M. Richards, Carrollton, TX (US); Thomas J. Frosell, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/374,911

(22) PCT Filed: Jul. 26, 2013

(86) PCT No.: PCT/US2013/052190

§ 371 (c)(1),
(2) Date: Jul. 27, 2014

(87) PCT Pub. No.: WO2015/012854

PCT Pub. Date: Jan. 29, 2015

(65) Prior Publication Data

US 2016/0123106 A1 May 5, 2016

(51) Int. Cl.

| | |
|---|---|
| ***E21B 23/00*** | (2006.01) |
| ***E21B 33/128*** | (2006.01) |
| ***E21B 33/129*** | (2006.01) |

(52) U.S. Cl.

CPC ..... *E21B 33/129* (2013.01); *E21B 23/00* (2013.01); *E21B 33/128* (2013.01)

(58) Field of Classification Search

CPC ..... E21B 23/00; E21B 33/129
USPC ..... 166/377
See application file for complete search history.

(56) References Cited

U.S. PATENT DOCUMENTS

| | | | | |
|---|---|---|---|---|
| 4,263,968 | A * | 4/1981 | Garner, Jr. | E21B 33/1295 166/120 |
| 5,311,938 | A * | 5/1994 | Hendrickson | E21B 33/1216 166/134 |
| 5,727,632 | A * | 3/1998 | Richards | E21B 33/1293 166/123 |
| 6,003,607 | A | 12/1999 | Hagen et al. | |
| 6,267,180 | B1 * | 7/2001 | Gazda | E21B 23/06 166/237 |
| 7,487,832 | B2 * | 2/2009 | Read, Jr. | E21B 17/06 166/123 |
| 8,240,390 | B2 * | 8/2012 | Hendrickson | E21B 33/129 166/118 |

(Continued)

FOREIGN PATENT DOCUMENTS

WO WO2005038193 A1 4/2005

*Primary Examiner* — Matthew R Buck
(74) *Attorney, Agent, or Firm* — McGuireWoods LLP

(57) ABSTRACT

A packer assembly is located in a compacted wellbore and a method of relieving compression on the packer assembly are disclosed. An initial load path that exists when the packer assembly is in a set position is altered. The alteration of the load path relieves substantially all of the compression on the packer assembly. This causes a lower packer mandrel to move towards an upper packer mandrel. This upward movement shortens the distance between the upper packer mandrel and the lower packer mandrel, which removes the compressive forces on the packer assembly.

19 Claims, 10 Drawing Sheets

(56) References Cited

U.S. PATENT DOCUMENTS

| | | | | |
|---|---|---|---|---|
| 8,291,989 | B2 * | 10/2012 | Kilgore | E21B 33/1285 166/387 |
| 8,505,623 | B2 * | 8/2013 | Williamson | E21B 33/1294 166/133 |
| 8,844,621 | B2 * | 9/2014 | Carro | E21B 33/1293 166/120 |
| 2012/0234560 | A1 | 9/2012 | Ezell et al. | |

* cited by examiner

RETRIEVAL OF COMPRESSED PACKERS FROM A WELLBORE

TECHNICAL FIELD

The present disclosure relates generally to a packer assembly and methods for relieving compression on a packer assembly located within a wellbore. The packer assembly can include a settable packer element. The packer assembly can also include slips that are engaged to the casing. When the packer assembly is to be retrieved, the packer element can be unset, and the slips can be disengaged from the casing. The compression at the bottom of the packer assembly can be relieved by changing the compression load path that was from the bottom of the packer mandrel to the slips. According to an embodiment, the packer assembly is used in an oil or gas well operation. Disengaging the slips allows the packer assembly to be retrieved from the wellbore.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
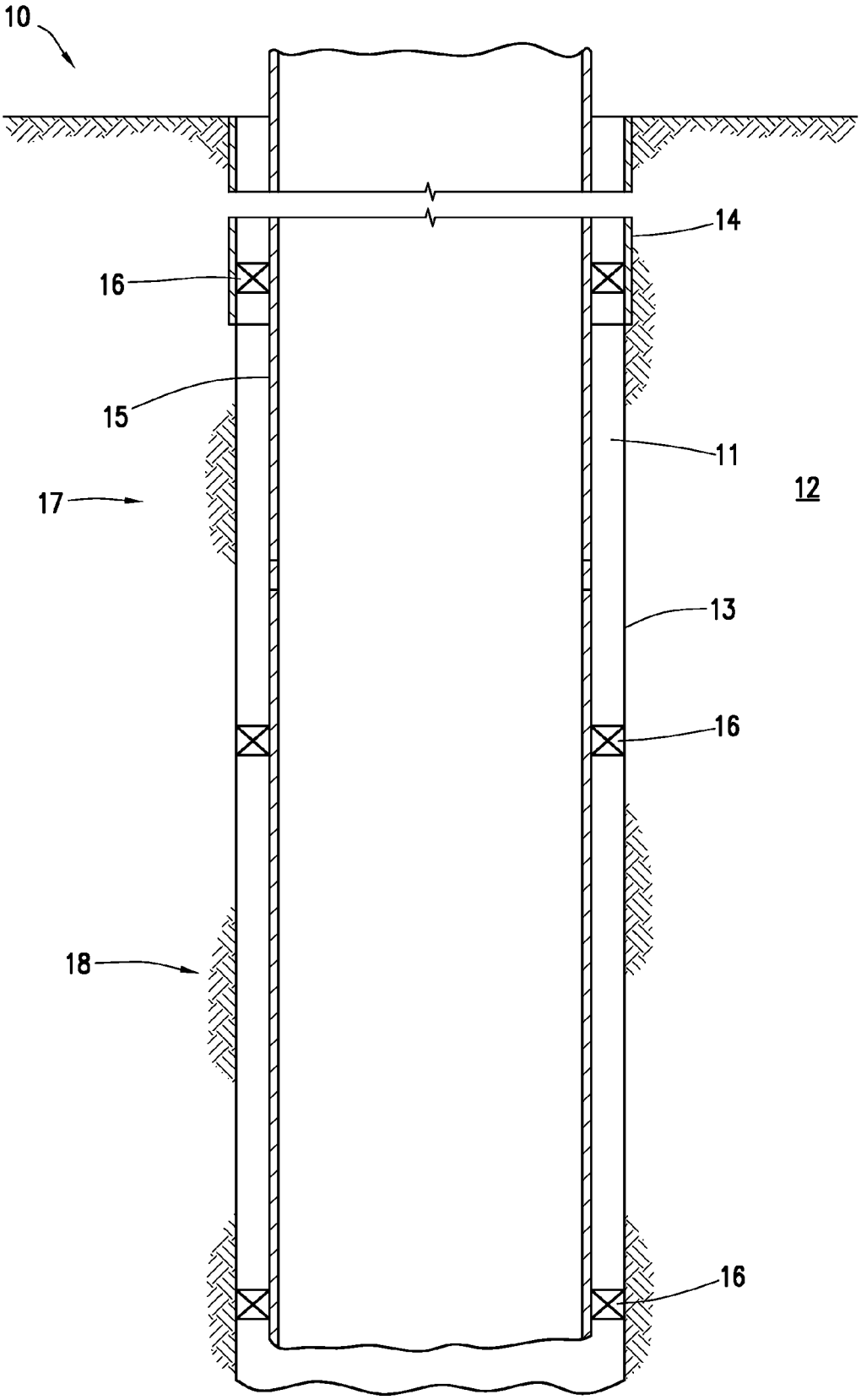
FIG. 1 is a schematic illustration of a well system containing a packer assembly according to one embodiment.

As used herein, the words "comprise," "have," "include," and all grammatical variations thereof are each intended to have an open, non-limiting meaning that does not exclude additional elements or steps.

As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas Oil and gas hydrocarbons are naturally occurring in some subterranean formations. In the oil and gas industry, a subterranean formation containing oil, gas, or water is referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from the wellbore is called a reservoir fluid.

A well can include, without limitation, an oil, gas, or water production well, an injection well, or a geothermal well. As used herein, a "well" includes at least one wellbore. The wellbore is drilled into a subterranean formation. The subterranean formation can be a part of a reservoir or adjacent to a reservoir. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered the region within approximately 100 feet radially of the wellbore. As used herein, "into a well" means and includes into any portion of the well, including into the wellbore or into the near-wellbore region via the wellbore.

A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

It is not uncommon for a wellbore to extend several hundreds of feet or several thousands of feet into a subterranean formation. The subterranean formation can have different zones. A zone is an interval of rock differentiated from surrounding rocks on the basis of its fossil content or other features, such as faults or fractures. For example, one zone can have a higher permeability compared to another zone. It is often desirable to treat one or more locations within multiples zones of a formation. One or more zones of the formation can be isolated within the wellbore via the use of an isolation device.

During well completion, it is commonly desired to seal a portion of an annulus so fluids will not flow through the annulus but rather flow through the tubing string or casing. By sealing the portion of the annulus, oil, gas, water, or combinations thereof can be produced in a controlled manner through the wellhead via the tubing string or casing. Different tools can be used to create seals in the well. Examples of such tools include packers and bridge plugs.

Packers can be utilized to seal the annulus in a wellbore. Typically, packers are used to anchor the tubing to the wellbore and to seal the tubing to the wellbore. A packer can be used in cased wellbore portions or open-hole wellbore portions. A packer can include an element that seals to the wellbore to isolate the portion of the wellbore and also slips that grip the inside of a casing or wall of the wellbore to anchor the packer to the casing or wellbore wall. Rubber elements are used to create a seal in the wellbore. A setting method can activate or energize the packing elements and slips while a releasing method can return the packer to the un-set position. A gravel pack packer can use a setting tool to apply compression to energize the packing element and slips. A hydraulic packer has an internal setting piston that is hydraulically actuated to apply the compression to energize the packing element and slips. A hydrostatic set packer has an atmospheric chamber that collapses with well hydrostatic pressure to supply the compressive forces needed to set the packer. A mechanical packer uses compression of the tubing string to apply the compressive force needed to energize the element and slips. All of these types of packers have a packer element that is a ring of elastomeric material fitted on the outside of a mandrel. The actuation of the packer axially squeezes the packer element to cause radial expansion of the packer element and seals the annulus. The actuation of the packer deploys the slips to grip and anchor the packer to the inside of the casing or wall of the wellbore.

A packer can be introduced into or run into the wellbore on a work string or on a production tubing during the course of treating and preparing the well for production. The packer can act as an isolation device. For example, the packer can be used to substantially seal the annulus between the outside of the production tubing and the inside of the casing or wall of the wellbore by blocking the movement of fluids through the annulus past the packer location. Packers can also be used as service tools.

A retrievable packer can typically include four main components: a mandrel or body, a packing or sealing element, a slip system that includes the slips and slip props for allowing the slips to engage the inner diameter (I.D.) of a casing or wall of a wellbore, and a releasing mechanism that can return the packer to a substantially un-set position. A portion of the slips generally contain teeth that allow the packer to engage with the I.D. of the casing or wall of the wellbore to set the packer in the wellbore. On occasion, it may become necessary to remove packers from the wellbore. For example, the well operator can require the retrieval of the packer to re-work the well or to change out the production tubing. To release the packer, a load device can be disengaged from the mandrel. This disengagement removes the transfer of compressive forces to the slip props and the lower part of the mandrel can move downward into the wellbore. This causes or allows the slip prop to also move downward such that the slip is disengaged, and the packer is released and can be retrieved. However, it can be difficult to release a packer if the packer is subjected to relatively large compressive forces in the wellbore.

Compaction of the formation can result from the extraction of hydrocarbons, fluids, sand, etc. during well production. The flow of these substances can result in subsidence such that the bottom of the wellbore can shrink upwards towards the bottom of the packer. In such instances, due to the compacted formation, the packer and associated completion equipment below the packer are subjected to a large amount of compression. As a result of the compression, it can become extremely difficult to retrieve the packer during a workover of the well due to the lower part of the mandrel being incapable of moving downward in the wellbore. The occurrence of compression can sometimes be predicted and additional equipment such as compaction joints or shear joints can be placed below the packer to compensate for the compressive forces. However, these other assemblies take up space and require additional tools or operations to release. They can also overly complicate well operations. Other invasive operations, such as milling the packer, or cutting the tubing string below the packer to relieve the compression, can also be performed in order to release and remove the packer from the wellbore.

Some of the drawbacks with using conventional methods to retrieve a compressed packer include: the well intervention operations can result in expensive production downtime; specialized personnel and tools can be needed to conduct these operations; and these operations can be invasive in nature. Currently, there are not any non-invasive methods to relieve the compressive forces on the packer to thereby release the slips from engagement with the I.D. of the tubing string or wall of the wellbore. Therefore, there is a need for a new packer retrieval mechanism/assembly and a non-invasive method of relieving compression from below a packer so that the packer can be retrieved from the wellbore.

It has been discovered that shortening the length of a portion of a packer mandrel, the packer can be released from a compressed wellbore. By being able to release the slips, the packer can be easily retrieved from the wellbore while minimizing production downtime due to well intervention/milling operations.

According to an embodiment, a novel method of relieving compression on a packer assembly located in a wellbore comprises: causing the length of the packer assembly to be shortened, wherein the packer assembly comprises: a packer mandrel, wherein the packer mandrel comprises an upper packer mandrel and a lower packer mandrel; and a sleeve, wherein the sleeve is sealably connected to the upper packer mandrel and the lower packer mandrel, wherein the sleeve is shifted upward such that the lower packer mandrel is released, and wherein the lower packer mandrel is moved upward relative to the upper packer mandrel.

The packer assembly further comprises: a slip system wherein the slip system is located on the outside of the packer mandrel, and wherein the slip system comprises: a slip; and a slip prop, wherein the slip prop is capable of supporting the slip such that the slip engages an inner diameter of a casing or a wall of the wellbore; and a load device, wherein the load device cooperates with the slip prop to support the slip, and wherein the load device is engaged with the packer mandrel when the packer assembly is in a set position.

The packer assembly further comprises a tailpipe relief assembly, wherein the tailpipe relief assembly comprises: a positioning device, wherein at least a portion of the positioning device is attached to the lower packer mandrel; and a positioning prop, wherein a first end of the positioning prop is capable of supporting at least a portion of the positioning device in a first position. The tailpipe relief assembly can further comprise an end cap, wherein the positioning device can be engaged with the end cap when the positioning device is in the first position. The tailpipe relief assembly can also comprise a housing, wherein the housing can be connected to the end cap, and wherein the housing is operatively connected to the slip prop.

According to another embodiment, a method of retrieving a packer assembly from a wellbore comprises: (A) locating a retrieving tool in the packer assembly, wherein the packer assembly comprises: a packer mandrel, wherein the packer mandrel comprises an upper packer mandrel and a lower packer mandrel; and a sleeve, wherein the sleeve is sealably connected to the upper packer mandrel and the lower packer mandrel, and wherein the retrieving tool is located inside a profile in the sleeve; and a load device, wherein the load device is engaged with the packer mandrel when the packer assembly is in a set position; and (B) unsetting the packer assembly, wherein unsetting the packer assembly comprises: applying an upward force on the retrieval tool, wherein application of the upward force shifts the sleeve upward and causes the load device to become disengaged from the packer mandrel; and disengaging the lower packer mandrel such that compression forces on the packer assembly are substantially relieved. The method further includes applying a downward force on the retrieval tool, wherein the application of the downward force causes the lock ring to engage the packer mandrel, and wherein the application of the downward force is transferred from the retrieval tool through the packer mandrel to the lock ring causing the lower slip prop to be moved a sufficient distance and such that the slip is incapable of being engaged with the inner diameter of the casing or the wall of the wellbore.

According to the present disclosure, the packer assembly is capable of being retrieved even when it is subjected to a relatively large amount of compression in the wellbore. The sleeve is shifted using, for example, via a retrieval tool. This application of an upward force on the packer mandrel followed by a subsequent downward force on the packer mandrel relieves the load on the slips such that the slips can be disengaged from the inner diameter (I.D.) of the casing or the wall of the wellbore. Additionally, the bottom end of the packer assembly can be shortened thereby relieving the compression below the packer assembly.

Turning to the Figures, FIG. 1 depicts a well system 10. The well system 10 can include at least one wellbore 11. The wellbore 11 can penetrate a subterranean formation 12. The wellbore 11 comprises a wall 13. The subterranean formation 12 can be a portion of a reservoir or adjacent to a reservoir. The wellbore 11 can include a casing 14. The wellbore 11 can include only a generally vertical wellbore section or can include only a generally horizontal wellbore section. One or more tubing strings, for example, a tubing string 15 can be installed in the wellbore 11. The tubing string 15 can provide a conduit for fluids to travel from the formation to the surface of the wellbore 11 or vice versa. A packer assembly 16 can be run into the wellbore 11. The packer assembly 16 can provide an annular seal between the outside of the tubing string 15 and the inside of the casing 14 or wall of the wellbore 13 to define zones 17, 18. The packer assembly 16 can also be used between the outside of a first tubing string and the inside of a second tubing string (not shown). The packer assembly 16 can be used to seal or "pack off" the wellbore 11 such that the flow path of fluids in the wellbore 11 can be redirected.

It should be noted that the well system 10 illustrated in the drawings and described herein is merely one example of a wide variety of well systems in which the principles of this disclosure can be utilized. For instance, the wellbore 11 can have a horizontal section and a vertical section. It should be clearly understood that the principles of this disclosure are not limited to any of the details of the well system 10, or components thereof, depicted in the drawings or described herein. Furthermore, the well system 10 can include other components, such as, production tubing, screens, and other isolation devices not depicted in the drawing. According to the various embodiments, one or more packers can be introduced into multi-zone completions, between an inner and outer string, and in a vertical and/or horizontal section of the wellbore 11. The packer assembly 16 can be installed in the wellbore 11 during well completion operations or well testing operations. The packer assembly can be located in a cased wellbore section or an open-hole wellbore section. There can also be more than one packer assembly located within the wellbore in a variety of location, for example in cased sections, open-hole sections, or combinations thereof.

Figure 2:
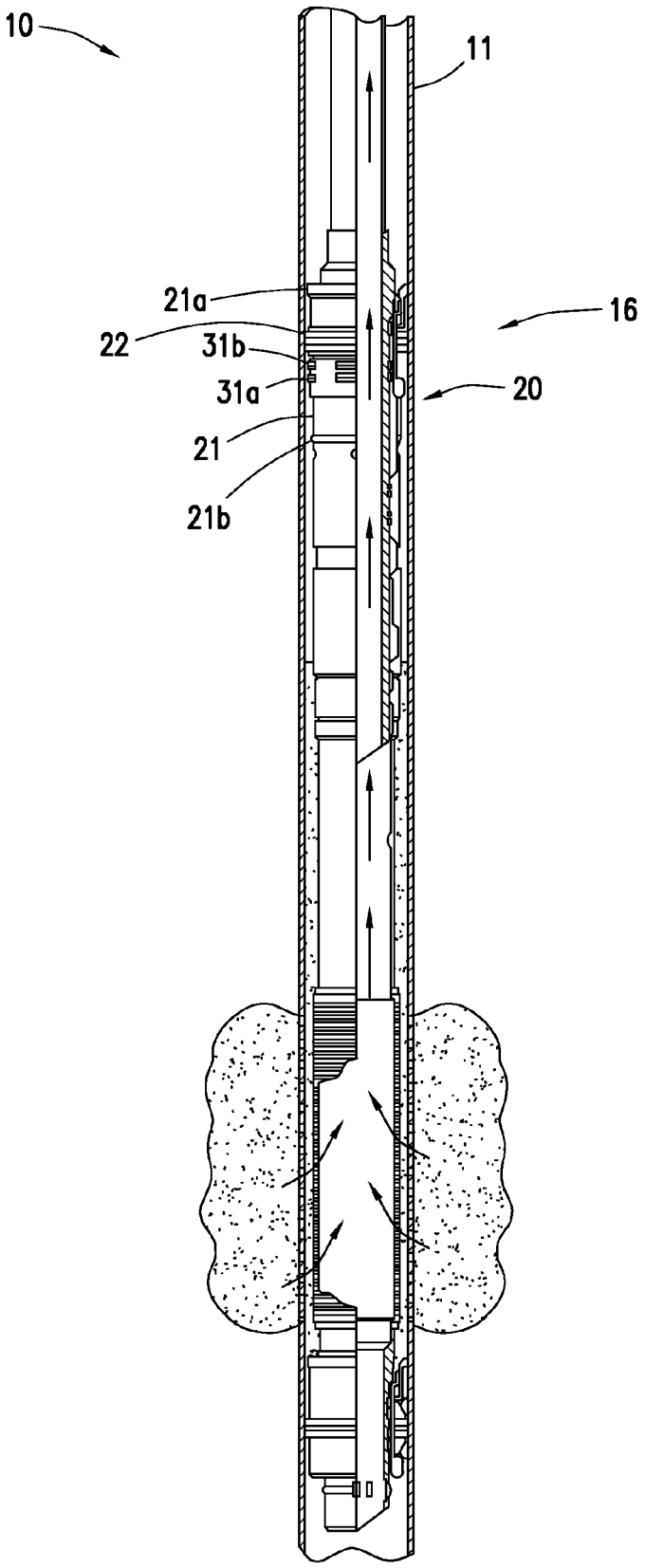
FIG. 2 is a plan view of a gravel pack assembly containing a packer assembly according to one embodiment.

Referring now to FIG. 2, according to one embodiment, the packer assembly 16 can be a gravel pack packer 20 that is used to support and retain gravel placed during gravel pack operations. In another embodiment, the packer assembly 16 can be a hydraulic packer (not shown) that can be set with the application of tubing pressure or a hydrostatic set packer (not shown) that can be set with the application of wellbore hydrostatic pressures. Any combination of setting methods can be employed to set the packer. An example of a gravel pack assembly 20 is the Sand Control Versa-Trieve® Packer, marketed by Halliburton Energy Services, Inc. The packer assembly 16 can include a body or packer mandrel 21. The packer mandrel 21 can include an upper packer mandrel 21*a* and a lower packer mandrel 21*b*. The packer assembly 16 can also include a slip 23. Any discussion of a particular component of an embodiment (e.g., a slip, a desired wellbore zone, etc.) is meant to include the singular form of the component and also the plural form of the component, without the need to continually refer to the component in both the singular and plural form throughout. For example, if a discussion involves "the lug 41," it is to be understood that the discussion pertains to one lug (singular) and two or more lugs (plural). The slip 23 can be biased outwardly away from a central, vertical axis of the packer mandrel 21.

Figure 3A:
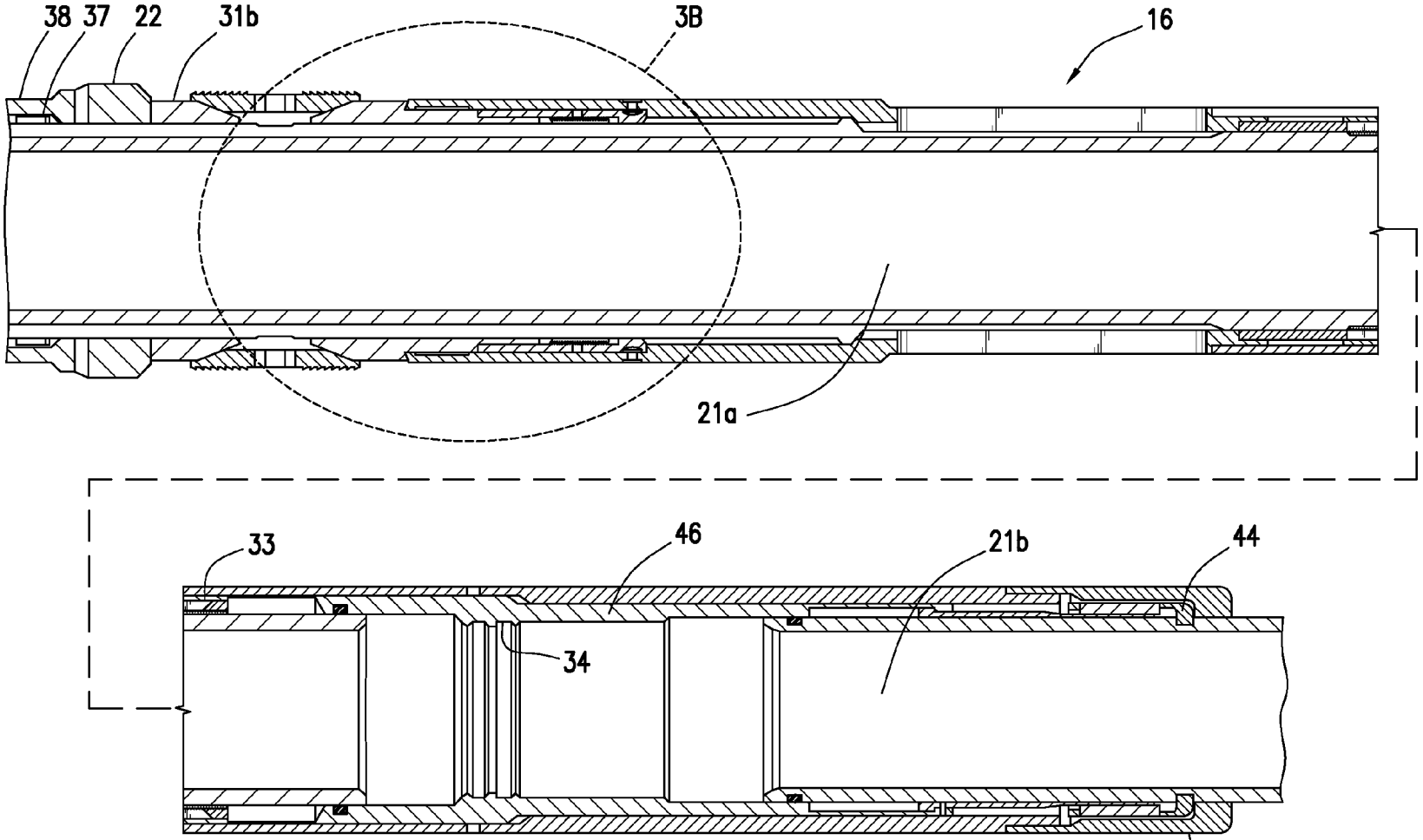
FIGS. 3A and 4 are cross-sectional views of a packer assembly according to one embodiment.
Figure 3B:
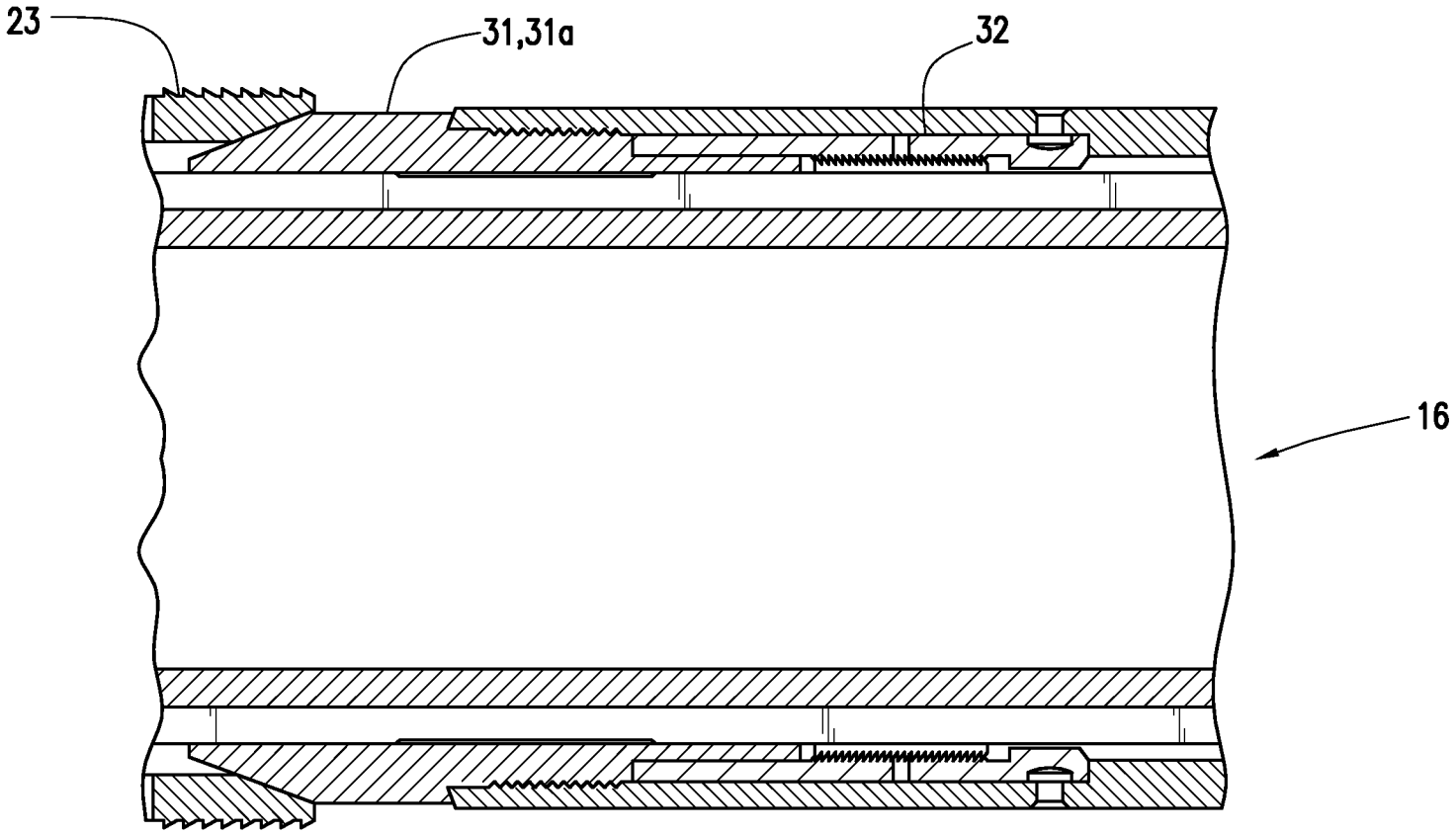
FIG. 3B is a cross-sectional view of a packer assembly comprising a lock ring according to one embodiment.

Referring to FIGS. 3A and 3B, the packer assembly 16 can include a body or packer mandrel 21. The packer mandrel 21 can include an upper packer mandrel 21*a* and a lower packer mandrel 21*b*. The packer assembly 16 can also include a slip 23 and a packing or a sealing element 22. The packing element 22 can be located on the outside of the upper packer mandrel 21*a*. The packing element 22 can radially expand outwardly away from the mandrel to provide a substantially pressure tight seal in an annulus, for example between the outside of a tubing string and the inside of the casing when the packer assembly 16 is set or located in a desired zone in the wellbore 11. The desired zone could be anywhere in the wellbore 11 including, for example, the riser in offshore applications. As described earlier, the packer assembly 16 can be subjected to compressive forces in the wellbore 11.

The details of the packer assembly 16 that is run or located within a compacted wellbore will be further described. It is to be understood that as depicted in these and the ensuing figures, the packer assembly 16 is in a set or operating position. As described earlier, the packer assembly 16 can include a packer mandrel 21. The packer mandrel 21 can allow fluids to flow from or into the subterranean formation via a conduit defined by a tubing string. While the packer mandrel 21 has been depicted in separate form, in other embodiments, the packer mandrel 21 can be an integral part of a tubing string.

The packer assembly 16 can include a slip system located on the outside of the packer mandrel 21. The slip system includes a slip 23. The slip 23 can be made from a single cylinder of material commonly referred to as a barrel slip, a set of slips retained in a groove on the slip prop commonly referred to as a dove-tail slip, or a slip retained by a housing with windows commonly referred to as a caged slip. The slip 23 can be located around a portion of the outside of the packer mandrel 21 and radially biased towards the outside of the packer mandrel 21. The slip 23 can have teeth on its face. As used herein, the term "teeth" includes one or more elements that are capable of grippingly engaging an I.D. of a tubing string, or casing, or wall of the wellbore to retain the packer assembly 16 in a set position. The teeth can be sharp ridges machined onto the face of the slip 23 or sharp elements, for example, buttons or other geometric shapes that are attached to the face of the slip 23. The slip system can further include a slip prop 31. The slip prop can include an upper slip prop 31*b* and a lower slip prop 31*a*. An upper and a lower end of each slip 23 can be formed having a conical or ramped surface. These surfaces are complementary to and can slidingly engage a parallel, ramped surface of the upper slip prop 31*b* and ramped surface of the lower slip prop 31*a*, respectively. In one position, the slip 23 can be positioned substantially adjacent to the packer mandrel 21 and axially separated from the slip prop 31 so that the outer diameter (O.D.) of the slip 23 is less than or equal to the O.D. of the slip prop 31. After the packer assembly 16 is run in the wellbore, it can be set. Setting the packer assembly 16 involves applying compression to the slip system to move the slip 23 axially towards and along the face of the slip prop 31 to move the slip 23 radially into engagement with the casing or wellbore and to allow the slip 23 to maintain engagement with the casing or wellbore wall. When the slip 23 is engaged with the casing or wellbore wall, the packer assembly 16 has substantially limited or no vertical movement within the wellbore. Setting the packer assembly 16 can further involve causing or allowing the packer elements to expand radially to form a pressure tight annular seal. The packer assembly can further include more than one slip system to facilitate setting of the packer assembly.

The slip prop 31 can support the slip 23 in an expanded position outward from the mandrel 21 such that the slip 23 engages the I.D. of the casing or the wall of the wellbore when the packer assembly 16 is set. The slip prop 31 can prevent the slip 23 from retracting and releasing from the casing or well bore once the packer assembly 16 is set. As used herein, the term "slip prop" can include a wedge, cone, or any device that can support the slip 23 when it is set.

The packer assembly 16 is capable of withstanding a relatively large amount of compression. While compressive forces hold the slip 23 securely in position such that it can be extremely difficult to disengage the slip 23 from its set position, according to the present disclosure, the slip prop 31 can also facilitate the release of the slip 23 and ensure re-setting of the slip 23.

A load device 33 can be in engagement with the packer mandrel 21. According to an embodiment, the load device 33 can facilitate the setting of the packer assembly 16 by cooperating with the lower slip prop 31*a* to cause the slip 23 to engage the I.D. of a casing string or the wall of the wellbore. Although the term "load device" has been used herein, the term is also intended to include, without limitation, a load ring, a lock ring, a ring, a collet, a pin, one or more lugs, and any other suitable device. The load device 33 maintains the position of the housing 49 to the position of the upper mandrel 21*a* by preventing relative movement and thereby maintaining the packer assembly 16 in the set position. The load device 33 cooperates with the lower slip prop 31*a* to support the slip 23 in engagement with the I.D. of the casing or the wall of the wellbore. The load device 33 retains the necessary setting force, such as an initial compression force applied to the packer element and the slip system.

Referring to FIG. 3A, an axial setting force is applied to the setting sleeve 38 to axially compress the packing element 22 to cause it to expand to the I.D. of the casing or wall of the wellbore 11. The axial force is transferred through the element 22 and into the upper slip prop 31*b* to cause the slip system to engage the I.D. of the casing or wellbore wall. The packing element 22 is subjected to mechanical pressure that causes it to be squeezed into high contract stress to the casing or the wall of the wellbore 11. The packing element 22 is retained on an upper end by a lock ring 37 that grips the packer mandrel 21. A lower end of the packing element 22 pushes against the upper slip prop 31*b* and into the slip 23. As the rubber pressure pushes up against the lock ring 37 that is gripping the packer mandrel 21, the packer mandrel 21 transfers the stress to the load device 33. The load device 33 transfers the force to the lower slip prop 31*a* and into the slip 23. The load device 33 keeps the packer assembly 16 in the set position by retaining the setting force from the lock ring and along the packer mandrel 21.

Tubing forces, namely, tension and compression, can be transferred to the slip 23 through the packer mandrel 21. Compression applied to the mandrel is transferred through the lock ring 37 to the packing element 22 and into the upper slip prop 31*b* and then into the slip. Tubing tension is transferred through the packer mandrel 21 to the load device 33 then to the lower slip prop 31*a* and into the slip 23. Similarly, compression forces below the packer assembly 16 can be transferred from the lower mandrel 21*b* to the cage 44 to the lugs 41 to the end cap 45 to the housing 49 to the slip props 31*a*/31*b* and into the slip 23.

In one embodiment, referring back to FIG. 3B, the packer assembly 16 can also include a lock ring 32. Again, while the term "lock ring" has been used herein, the term is also intended to include, without limitation, a load device, a collet, a ring, a c-ring, a pin, one or more lugs, and any other suitable device. The lock ring 32 can include one or more ratchets or teeth on an inside surface that abuts a corresponding ratchet mating profile on the packer mandrel 21. The lock ring 32 can be used in retrieving the packer assembly 16 by pulling the lower slip prop 31*a* away from the slip 23 as will be detailed later.

Figure 4:
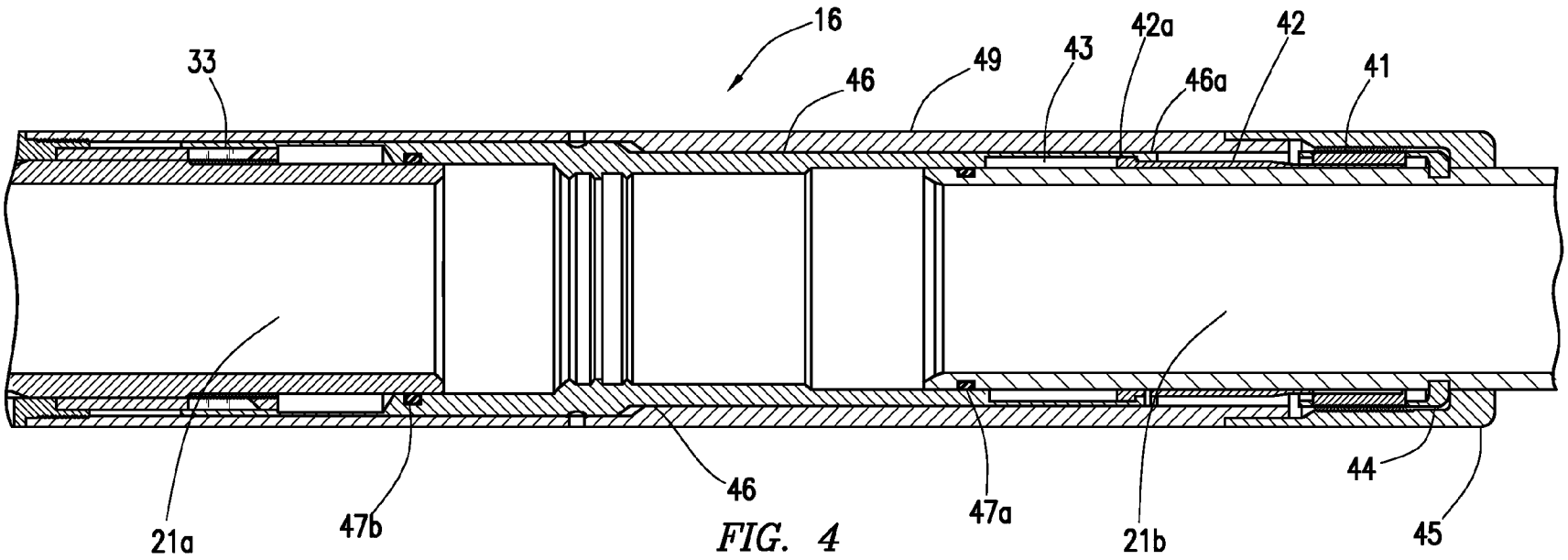

Referring now to FIG. 4, in one embodiment, the packer assembly 16 includes a sleeve 46. When the packer assembly 16 is set, the load device 33 is held against the mandrel by the sleeve 46. The sleeve 46 at least partially encloses or envelops the packer mandrel 21. At least a portion of the sleeve 46 terminates in a sleeve shoulder 46*a*. The sleeve 46 can be connected to the packer mandrel 21 and lower packer mandrel 21*b* by a sealing element 47*a* and 47*b*. For example, the sleeve 46 can be connected to the packer mandrel 21 by one or more O-rings. The sleeve 46 can include a preconfigured mating profile 34, such as a recessed profile. The mating profile 34 can engage with a matching profile of, for instance, a retrieval tool (not shown) when the packer assembly 16 and the retrieval tool are brought into cooperative alignment. After the slip 23 is released, the packer assembly 16 can be retrieved using the retrieval tool.

The packer assembly 16 includes the packer mandrel 21 and a lower packer mandrel 21*b*. The lower packer mandrel 21*b* can be threadingly engaged with a tailpipe (not shown). The tailpipe can include tubing or other completion equipment that are run below the packer assembly 16. The tailpipe is subjected to a large amount of compression when the packer assembly 16 is located within a compacted wellbore. According to one embodiment, the compression can be relieved or at least substantially relieved by activating a tailpipe relief assembly that is attached to the lower packer mandrel 21*b*. The tailpipe relief assembly can include a positioning device attached to the lower packer mandrel 21*b* and a positioning prop, wherein a first end of the positioning prop is capable of supporting at least a portion of the positioning device in a first position, and wherein the portion of the positioning device is in the first position prior to causing the length of the packer assembly to be shortened (i.e., the packer is in the set position). The positioning device can include a cage 44 and a lug 41, a collet, a c-ring, or a dog. The positioning prop can be a lug prop, a collet prop, a c-ring prop, or a dog prop. When the positioning device is in the first position, at least a portion of the positioning device can be operatively connected to the slip system. By way of example, for a collet, a finger of the collet can be connected to an end cap 45 and/or an outer housing 49 when the collet is in the first position. Although some of the discussion with reference to the figures discusses a cage, lug, and lug prop, it is to be understood that a collet or a dog and a collet prop or a dog prop could be used to relieve the compression on the packer assembly. A second end of the lug prop 42 terminates in a lug prop shoulder 42*a*.

The tailpipe relief assembly can further include a housing 49. The housing 49 can be threadingly connected to an end cap 45 and the housing 49 can be operatively connected to the lower slip prop 31*a*. In one embodiment, the housing 49 is threadingly connected to the lower slip prop 31*a*.

When the packer assembly is in the set position, force from an area below the packer is transferred via a load path from the lower mandrel 21*b* to the slip system via the positioning device in the first position. By way of example, if the positioning device is a cage, lug, and lug prop, then the force can be transferred to the slip system via the lower mandrel to the cage 44, to the lug 41, to the end cap 45, to the housing 49, and to the slip system when the lug is in the first position. By way of another example, for a collet, the force can be transferred to the slip system via the lower mandrel to the collet, to the end cap and/or housing, to the slip system. In this manner, the force required to maintain the packer in the set position can be partially supplied by compressive forces below the packer.

According to an embodiment, and referring generally to FIGS. 4-8, a method of relieving compression on a packer assembly 16 located in a wellbore comprises shifting the sleeve 46, thereby causing at least a portion of the positioning device to become disconnected from the slip system. For example, the lug 41 can become disengaged from the end cap 45 such that the lug is no longer operatively connected to the slip system via the end cap and/or housing. When the positioning device is disconnected from the slip system, at least some of the compression on the slip system is relieved.

When the packer assembly 16 has to be retrieved, such as during workover operations, a retrieval tool can be introduced into the packer assembly 16. As mentioned earlier, the packer assembly 16 can be subjected to extremely large compressive forces in the wellbore. The retrieval tool can be anchored with a set of keys engaged inside the mating profile 34 on the sleeve 46. Although the retrieval tool is anchored in position, it can be moved up or down by exerting an upward or downward force such as by pulling upward or pushing downward on the retrieval tool. As used herein, the relative term "upward" is used to indicate in a direction that is toward the wellhead. The relative term "downward" is used to indicate in a direction away from the wellhead. The mating profile 34 can be designed specifically such that it can only receive the retrieval tool and is not accidentally tripped by any other tool. When the retrieval tool is pulled upward, the sleeve 46 is also shifted upward by pulling up the mating profile 34.

When the sleeve 46 is shifted upward, the load device 33 is uncovered and is disengaged from the packer mandrel 21. The load device 33 can be biased radially to expand out of engagement with the packer mandrel 21 and is received into a load device recess or groove 51. When the load device 33 is received in the load device recess 51, the lower slip prop 31*a* is no longer supported and can be moved downward when compression forces are not present. When the lower slip prop 31*a* is moved downward, the slip 23 is no longer supported and is thereby disengaged from the I.D. of the casing or the wall of the wellbore. The packer mandrel 21 is free to travel upwards to release the force in the packing element and to allow the packer assembly 16 to substantially return to its run-in position. Accordingly, in one embodiment, the application of an upward force may be sufficient in itself to facilitate the release or unpropping of the slip 23. When the slip 23 is released, the packer assembly 16 can be retrieved from the wellbore relatively easily and without the use of any invasive techniques.

According to another embodiment, the method includes the steps of: (i) releasing the load device 33 when the sleeve 46 is shifted upward (as described above) from engagement with the packer mandrel 21 and (ii) activating the tailpipe relief assembly to relieve tailpipe compression. Activation of the tailpipe relief assembly can happen (i) subsequent to the load device 33 being released, (ii) simultaneously with the release of the load device 33, or (iii) prior to the release of the load device 33. Irrespective of the sequence in which these steps occur, the compression on the packer assembly 16 can be relieved and the slip 23 can be disengaged from the I.D. of the casing or the wall of the wellbore.

Figure 5A:
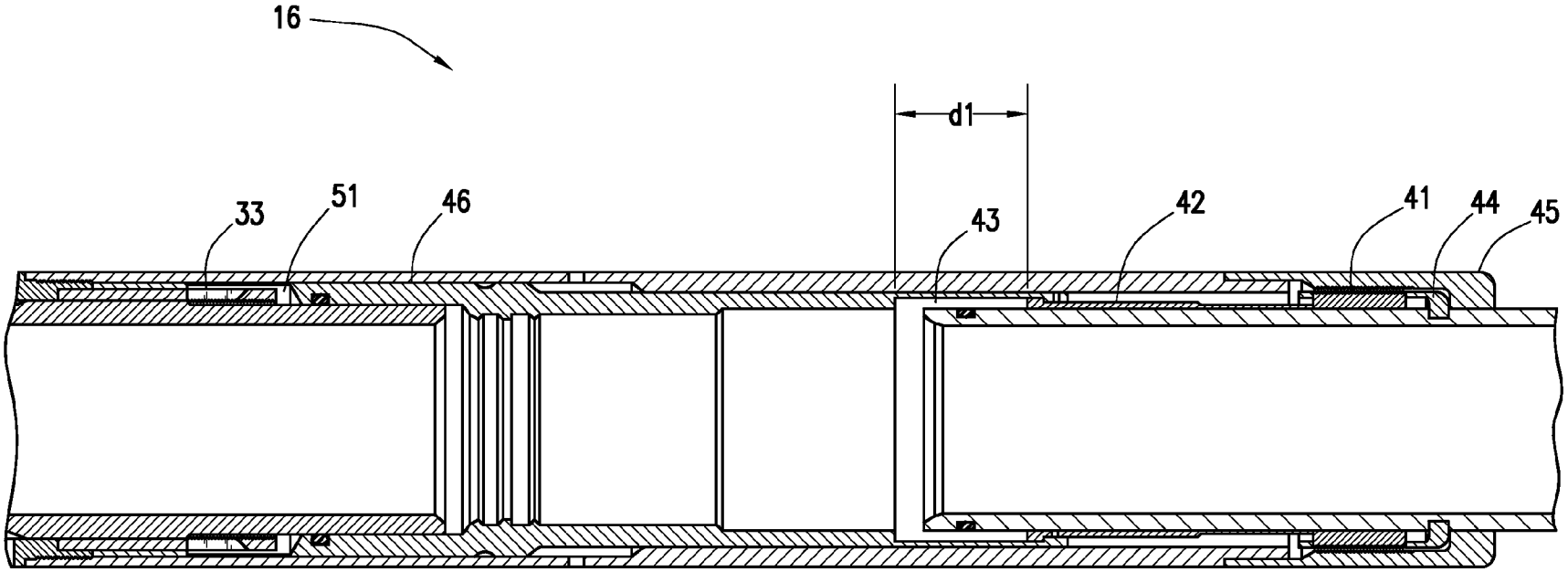
FIGS. 5A and 5B are cross-sectional views of a set packer prior to releasing the slips according to one embodiment.
Figure 8:
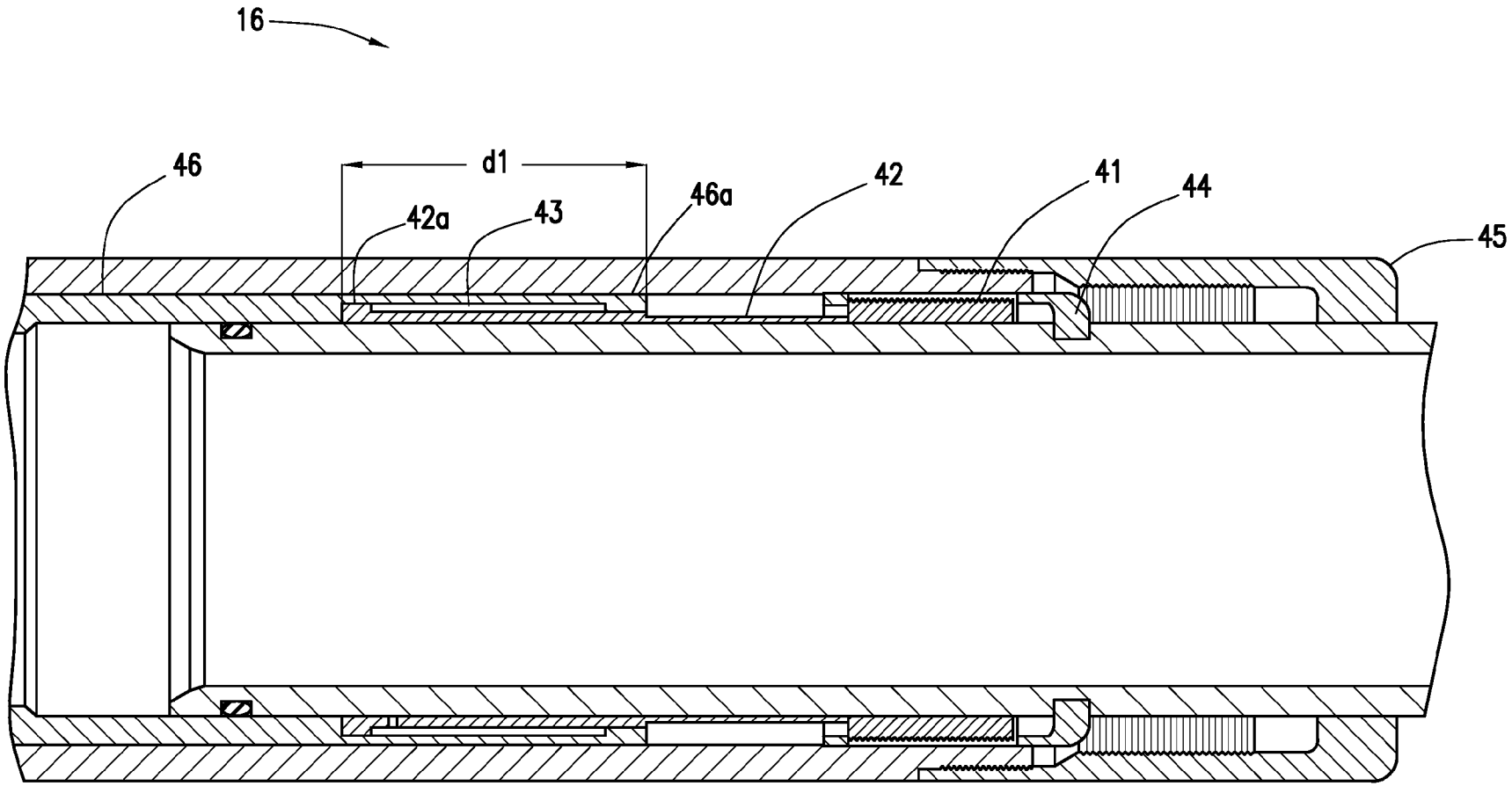
FIG. 8 is a cross-sectional view of a packer assembly wherein the bottom end of the packer assembly has been shortened after the application of an upward force according to one embodiment.

According to one embodiment and as can be seen, for example in FIG. 5A, the upward force causes the positioning device to move to a second position, and wherein when the positioning device is in the second position, the load path is diverted away from the slip system. When the positioning device is in the second position, the lower packer mandrel 21*b* can move towards the upper mandrel. The movement into the second position can include causing the positioning prop (e.g., a lug prop 42) to move upwards in the wellbore. The lug prop 42 moves upwards by the application of an upward force on the sleeve 46 via the shouldered connection of the sleeve to the second end of the lug prop. In one embodiment, the lug prop 42*a* continues to move upward within the cavity 43. When the lug prop 42*a* can move a sufficient distance d1 within the cavity 43, as depicted in FIG. 8, the positioning device (e.g., a lug 41) can collapse. After collapsing, the positioning device can be disengaged from the end cap and/or housing. The distance d1 can be designed to be sufficient enough to relieve either all, substantially all, or at least a portion of the tailpipe compression. Accordingly, distance d1 is a "tailpipe relief distance." When lug prop 42 traverses the tailpipe relief distance, the lug 41 is no longer supported in the expanded, first position and is released from the operative connection to the slip system. The tailpipe relief distance can be factored in when designing the dimensions of the cavity 43.

When the sleeve 46 is shifted upward, such as, by pulling up on the retrieval tool, it causes the sleeve shoulder 46*a* to come into telescopic connection with the lug prop shoulder 42*a* within the cavity 43 defined by at least a portion of an outer surface of the lower packer mandrel 21*b* and at least a portion of the sleeve 46. As used herein, the term "cavity" can include a recess, slit, or any passage that can receive the movement of the lug prop 42. The shouldered telescopic connection causes the lug prop 42 to move upwards along the lower packer mandrel 21*b* such that the lug prop 42 no longer support the lug 41 in the expanded position. The lug 41 can then be disengaged from the end cap 45.

Once the lug 41 is disengaged from the end cap 45, the load path that existed when the packer was in the set position is altered. After disengagement, the lug 41 is no longer able to transfer the compressive load to the end cap 45 for further transfer up to the slip system. The alteration of the load path relieves at least a portion of the compression on the slip system. In another embodiment, substantially all the compression on the slip system is relieved by the alteration of the load path. The disengagement of the lug 41 from the end cap 45 can also cause the lower packer mandrel 21*b* and possibly the cage 44, the lug 41, and the lug prop 42 to move upwards. This upward movement shortens the distance between the upper packer mandrel 21 and the lower packer mandrel 21*b*, which removes the compressive force on the tailpipe.

Figure 5B:
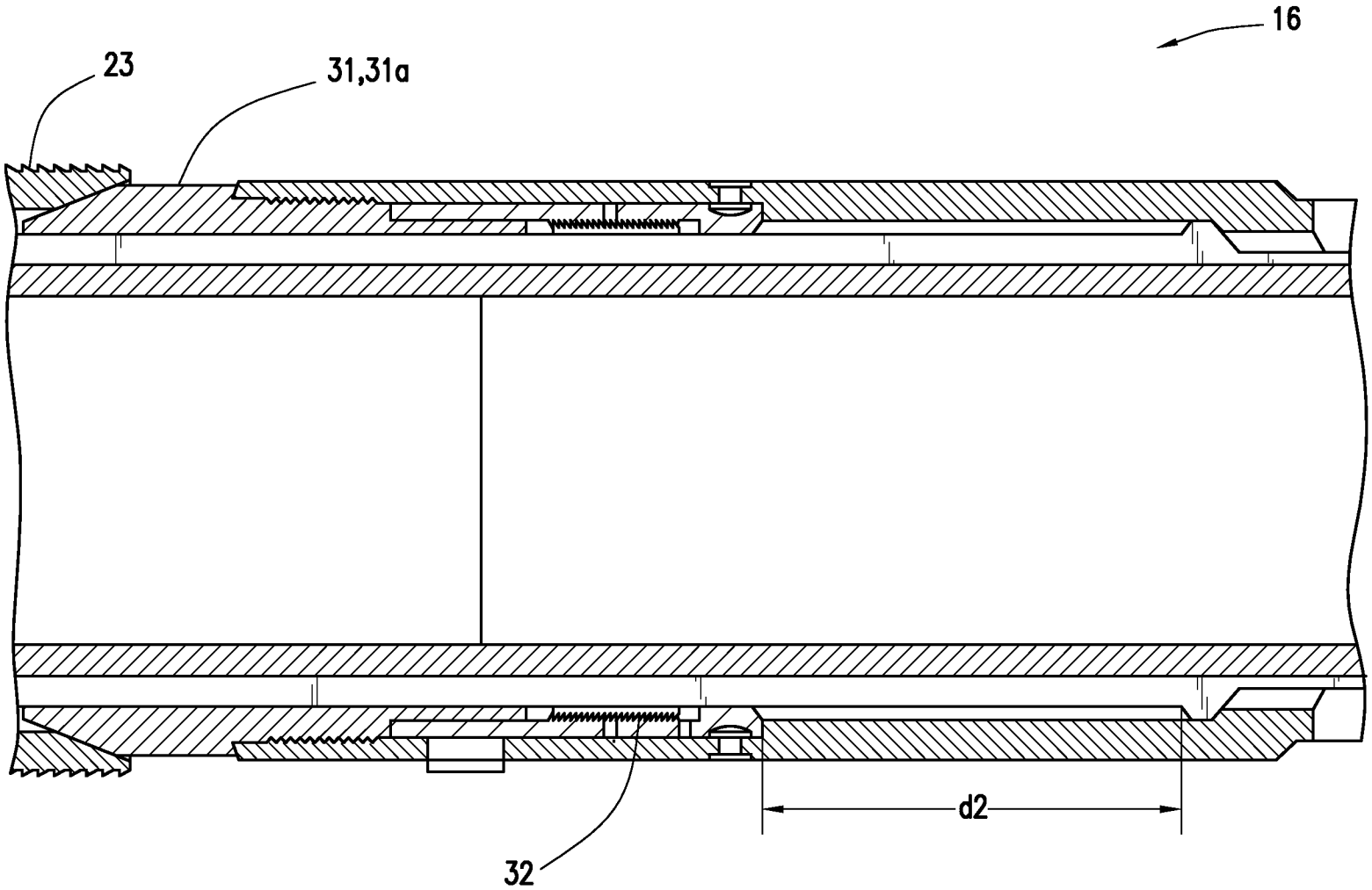
Figure 6:
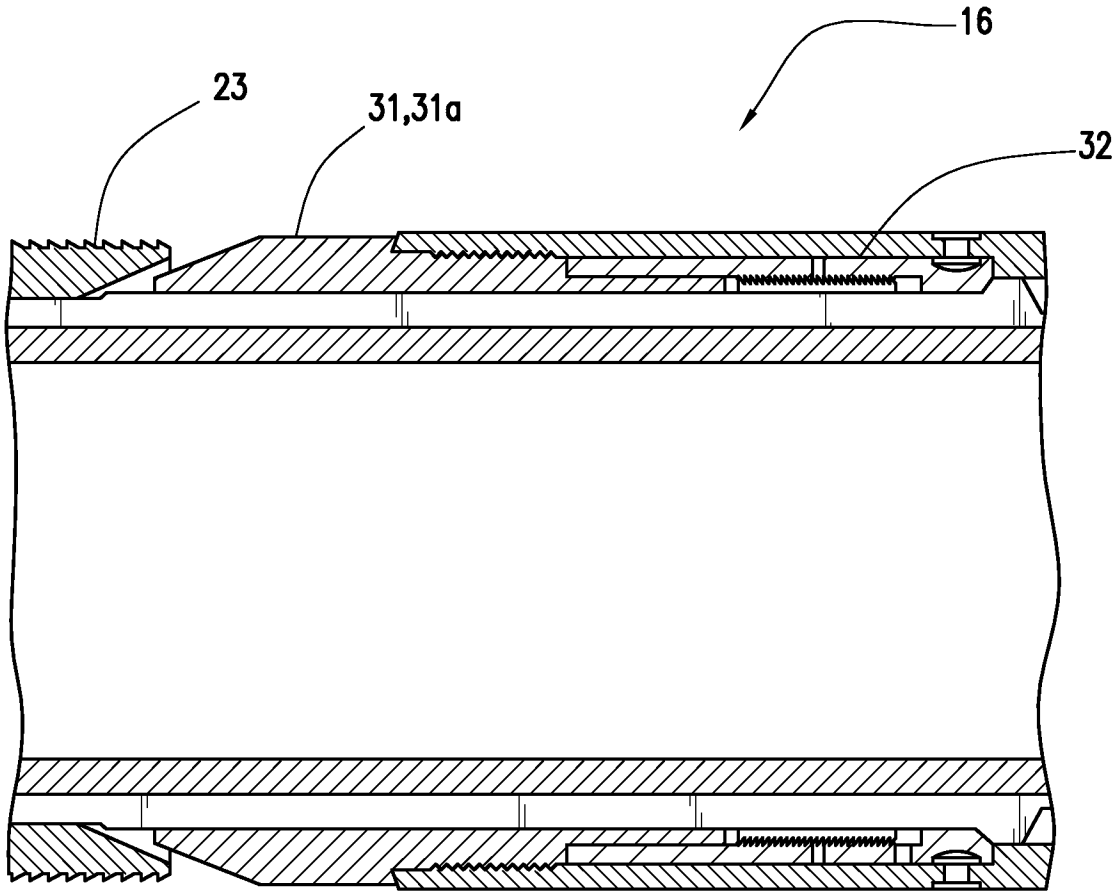
FIGS. 6 and 7 are cross-sectional views of a packer assembly comprising an expanded load device according to one embodiment.
Figure 7:
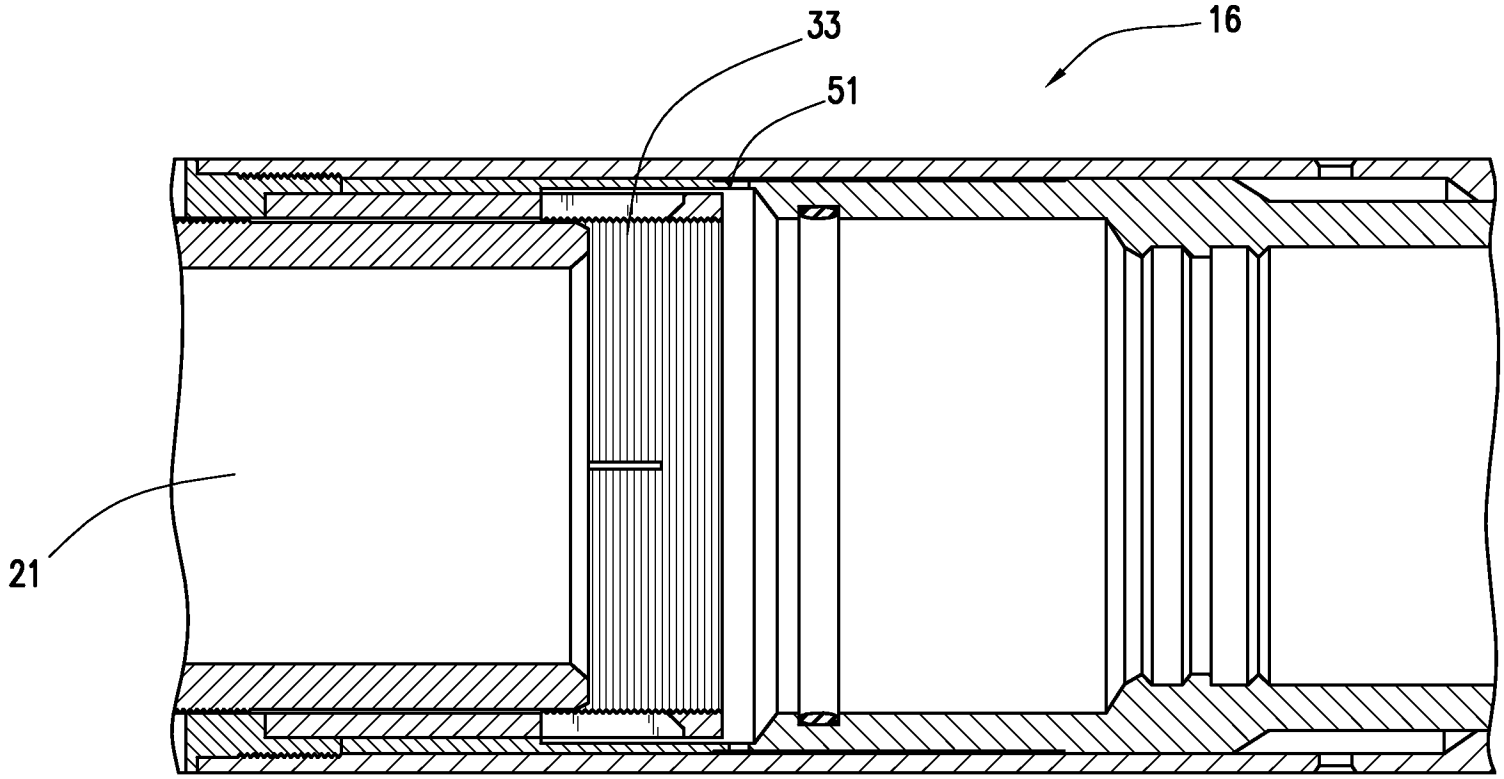

According to another embodiment, when an excessively large amount of compression is present in the wellbore, such as, due to the compaction of the formation, a method of relieving compression on the packer assembly involves utilizing the earlier mentioned lock ring 32. As used herein, the relative terms "excess" or "excessively large amount" mean a larger than normal amount of compression in the wellbore and would be understood as such by a person of ordinary skill in the art. The lock ring 32 can be engaged with the packer mandrel 21 by a matching profile (not shown) machined on the packer mandrel 21. The packer mandrel 21 can move upwards as the lock ring 32 is designed to ratchet or slip into and out of engagement with the packer mandrel 21. The lock ring 32 will engage or grip the mandrel to resist downward movement of the packer mandrel 21. The lock ring 32 can be activated by pulling up on the packer mandrel 21. When activated, the lock ring 32 ratchets into the packer mandrel 21. When a downward force is subsequently applied to the packer mandrel 21, this downward force is transferred through the packer mandrel 21 to the lock ring 32. The downward force causes the ratcheted lock ring 32 to be pulled or moved downwards. The downward force on the lock ring 32 is transferred through a lock ring face through to a housing face to the housing 49. The downward force applied to the packer mandrel 21 is transferred through lock ring 32 to housing 49 and to the lower slip prop 31*a*. When the lock ring 32 moves downwards, it can also pull the lower slip prop 31*a* downward and out of engagement with the slips 23. The downward force applied to the packer mandrel 21 must be greater than the compression forces on the tailpipe. After all of the compression force on the tailpipe has been removed or released, the retrieving tool may only have to overcome the friction between the slip 23 and the slip prop 31. The lower slip prop 31*a* travels the sufficient distance d2 within a recess located within the sleeve 46, as shown in FIG. 5B. The unsupported slip 23 can therefore, collapse out of engagement with the I.D. of the casing or the wall of the wellbore. As described earlier, when the slip 23 is released, the packer assembly 16 can be retrieved from the wellbore relatively easily and without the use of any invasive techniques.

Distance d2 can be factored in when designing the dimensions of the recess. Ideally, the recess has dimensions such that when the lower slip prop 31*a* traverses a distance d2 in the recess, this distance is sufficient to release the slip 23 from engagement with the I.D. of the casing or the wall of the wellbore. The non-limiting embodiments described herein can minimize rig time involved in conducting expensive fishing operations to retrieve the packer assembly 16, and in particular, when the packer assembly 16 is subjected to a large amount of compression.

The methods can include retrieving the packer assembly 16 from the wellbore. The packer assembly 16 can be retrieve after activating the tailpipe relief assembly as described previously. The retrieval can also include removing the packer from the wellbore after the compression on the packer assembly has been relieved.

It should be understood that, as used herein, "first," "second," "third," etc., and "upper" and "lower" are arbitrarily assigned and are merely intended to differentiate between two or more positions, etc., as the case may be, and does not indicate any particular orientation or sequence. Furthermore, it is to be understood that the mere use of the term "first" does not require that there be any "second," and the mere use of the term "second" does not require that there be any "third," etc.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While apparatus (such as the packer assembly) and methods are described in terms of "comprising," "containing," or "including" various components or steps, the compositions and methods also can "consist essentially of" or "consist of" the various components and steps. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of relieving compression on a packer assembly located in a wellbore comprising:

causing the length of the packer assembly to be shortened, wherein the packer assembly comprises:

a packer mandrel, wherein the packer mandrel comprises an upper packer mandrel and a lower packer mandrel; and a sleeve, wherein the sleeve is sealably connected to the upper packer mandrel and the lower packer mandrel, wherein the method further comprises:

locating a retrieval tool inside a profile in the sleeve, the profile being configured to mate with a corresponding mating profile on the retrieval tool when the sleeve and the retrieval tool are cooperatively aligned engaging the profile of the sleeve with the mating profile of the retrieval tool to shift the sleeve upward such that the lower packer mandrel is released, and moving the lower packer mandrel towards the upper packer mandrel.

2. The method according to claim 1, wherein the packer assembly further comprises:

(A) a slip system wherein the slip system is located on the outside of the packer mandrel, and wherein the slip system comprises:

a slip; and a slip prop, wherein the slip prop is capable of supporting the slip such that the slip engages an inner diameter of a casing or a wall of the wellbore; and (B) a load device, wherein the load device cooperates with the slip prop to support the slip, and wherein the load device is engaged with the packer mandrel when the packer assembly is in a set position.

3. The method according to claim 2, wherein the shifting of the sleeve releases the load device such that the load device is disengaged from the packer mandrel.

4. The method according to claim 1, further comprising retrieving the packer assembly from the wellbore.

5. The method according to claim 2, wherein the packer assembly further comprises a lock ring, and wherein the lock ring cooperates with the slip prop to move the slip prop out of engagement with the slip.

6. The method according to claim 5, wherein an application of a downward force causes the lock ring to move the slip prop a sufficient distance such that the slip is incapable of being supported by the slip prop.

7. The method according to claim 1, wherein the movement of the lower packer mandrel towards the upper packer mandrel relieves substantially all of the compression on the packer assembly.

8. A method of relieving compression on a packer assembly located in a wellbore comprising:

causing the length of the packer assembly to be shortened, wherein the packer assembly comprises:

a packer mandrel, wherein the packer mandrel comprises an upper packer mandrel and a lower packer mandrel; and a sleeve, wherein the sleeve is sealably connected to the upper packer mandrel and the lower packer mandrel, wherein the sleeve is shifted upward such that the lower packer mandrel is released, wherein the lower packer mandrel is moved towards the upper packer mandrel, wherein the packer assembly further comprises:

(A) a slip system wherein the slip system is located on the outside of the packer mandrel, and wherein the slip system comprises a slip; and a slip prop, wherein the slip prop is capable of supporting the slip such that the slip engages an inner diameter of a casing or a wall of the wellbore; and (B) a load device, wherein the load device cooperates with the slip prop to support the slip, and wherein the load device is engaged with the packer mandrel when the packer assembly is in a set position, wherein the packer assembly further comprises a tailpipe relief assembly, wherein the tailpipe relief assembly comprises: a positioning device, wherein at least a portion of the positioning device is attached to the lower packer mandrel; and a positioning prop, wherein a first end of the positioning prop is capable of supporting at least a portion of the positioning device in a first position, and wherein the portion of the positioning device is in the first position prior to causing the length of the packer assembly to be shortened.

9. The method according to claim 8, wherein the positioning device comprises a cage and a lug, a collet, a c-ring, or a dog.

10. The method according to claim 9, wherein the positioning prop is a lug prop, a collet prop, a c-ring prop, or a dog prop.

11. The method according to claim 10, wherein releasing the lower packer mandrel comprises applying an upward force on the packer assembly, and wherein the portion of the positioning device is in the first position prior to the application of the upward force.

12. The method according to claim 11, wherein prior to the application of the upward force, an initial load path exists from the lower packer mandrel to the slip system via the positioning device in the first position.

13. The method according to claim 12, wherein the application of the upward force causes the positioning device to move to a second position, and wherein when the positioning device is in the second position, the load path is diverted away from the slip system.

14. The method according to claim 13, wherein the application of the upward force causes the positioning prop to move such that the positioning prop no longer supports the portion of the positioning device in the first position.

15. The method according to claim 14, wherein the upward force causes the sleeve to shift upward, and wherein the shifting of the sleeve causes the positioning prop to move.

16. A packer assembly comprising:

a packer mandrel, wherein the packer mandrel comprises an upper packer mandrel and a lower packer mandrel; and a sleeve, wherein the sleeve is sealably connected to the upper packer mandrel and the lower packer mandrel, wherein the sleeve comprises an inner profile that is configured to mate with a corresponding mating profile of a retrieval tool when the sleeve and the retrieval tool are cooperatively aligned, and is capable of being shifted upward by the retrieval tool when the mating profile of the retrieval tool engages the inner profile of the sleeve such that the lower packer mandrel is released, and wherein the lower packer mandrel is capable of being moved towards the upper packer mandrel such that the length of the packer assembly is shortened.

17. A method of retrieving a packer assembly from a wellbore comprising:

(A) locating a retrieving tool in the packer assembly, wherein the packer assembly comprises:

a packer mandrel, wherein the packer mandrel comprises an upper packer mandrel and a lower packer mandrel; and a sleeve, wherein the sleeve is sealably connected to the upper packer mandrel and the lower packer mandrel, and wherein the retrieving tool is located inside a profile in the sleeve; and a load device, wherein the load device is engaged with the packer mandrel when the packer assembly is in a set position; and (B) unsetting the packer assembly, wherein unsetting the packer assembly comprises:

applying an upward force on the retrieval tool, wherein application of the upward force shifts the sleeve upward and causes the load device to become disengaged from the packer mandrel; and disengaging the lower packer mandrel such that compression forces on the packer assembly are substantially relieved.

18. The method according to claim 17, wherein the packer assembly further comprises: a slip system wherein the slip system is located on the outside of the packer mandrel, and wherein the slip system comprises: a slip; and a slip prop, wherein the slip prop is capable of supporting the slip such that the slip engages an inner diameter of a casing or a wall of the wellbore, wherein the load device cooperates with the slip prop to support the slip, and wherein the load device is engaged with the packer mandrel when the packer assembly is in a set position.

19. The method according to claim 18, wherein an application of a downward force causes the slip prop to move such that the slip prop no longer supports the slip.

* * * * *